US007596499B2

(12) United States Patent
Anguera Miro et al.

(10) Patent No.: US 7,596,499 B2
(45) Date of Patent: Sep. 29, 2009

(54) MULTILINGUAL TEXT-TO-SPEECH SYSTEM WITH LIMITED RESOURCES

(75) Inventors: Xavier Anguera Miro, Tarragona (ES); Peter Veprek, Santa Barbara, CA (US); Jean-Claude Junqua, Santa Barbara, CA (US)

(73) Assignee: Panasonic Corporation, Osaka (JP)

( * ) Notice: Subject to any disclaimer, the term of this patent is extended or adjusted under 35 U.S.C. 154(b) by 1249 days.

(21) Appl. No.: 10/771,256

(22) Filed: Feb. 2, 2004

(65) Prior Publication Data

US 2005/0182630 A1 Aug. 18, 2005

(51) Int. Cl.
*G10L 21/00* (2006.01)

(52) U.S. Cl. ..... 704/277

(58) Field of Classification Search ..... 704/9, 704/258, 277

See application file for complete search history.

(56) References Cited

U.S. PATENT DOCUMENTS

| | | | | |
|---|---|---|---|---|
| 4,913,539 | A * | 4/1990 | Lewis | 352/87 |
| 5,278,943 | A * | 1/1994 | Gasper et al. | 704/200 |
| 5,400,434 | A * | 3/1995 | Pearson | 704/264 |
| 5,805,832 | A * | 9/1998 | Brown et al. | 711/1 |
| 5,897,617 | A * | 4/1999 | Collier | 704/260 |
| 5,930,755 | A * | 7/1999 | Cecys | 704/260 |
| 6,233,561 | B1 * | 5/2001 | Junqua et al. | 704/277 |
| 6,460,017 | B1 * | 10/2002 | Bub et al. | 704/256 |
| 6,529,871 | B1 * | 3/2003 | Kanevsky et al. | 704/246 |
| 6,549,883 | B2 * | 4/2003 | Fabiani et al. | 704/10 |
| 6,604,075 | B1 * | 8/2003 | Brown et al. | 704/270.1 |
| 6,813,607 | B1 * | 11/2004 | Faruquie et al. | 704/276 |
| 6,952,665 | B1 * | 10/2005 | Shimomura et al. | 704/2 |

FOREIGN PATENT DOCUMENTS

| | | |
|---|---|---|
| EP | 0461127 B1 | 9/1995 |
| EP | 0786132 B1 | 4/2000 |
| JP | 2000-352990 | 12/2000 |

OTHER PUBLICATIONS

"Foreign-Language Speech Synthesis", Nick Campbell, Third ESCA/COCOSDA Workshop on Speech Synthesis, Jenolan Caves, Blue Mountains, Australia, Nov. 26-29, 1998.

* cited by examiner

*Primary Examiner*—Michael N Opsasnick
(74) *Attorney, Agent, or Firm*—Harness, Dickey & Pierce, PLC

(57) ABSTRACT

A multilingual text-to-speech system includes a source datastore of primary source parameters providing information about a speaker of a primary language. A plurality of primary filter parameters provides information about sounds in the primary language. A plurality of secondary filter parameters provides information about sounds in a secondary language. One or more secondary filter parameters is normalized to the primary filter parameters and mapped to a primary source parameter.

36 Claims, 6 Drawing Sheets

MULTILINGUAL TEXT-TO-SPEECH SYSTEM WITH LIMITED RESOURCES

FIELD OF THE INVENTION

The present invention generally relates text-to-speech systems and methods, and particularly relates to multilingual text-to-speech systems having limited resources.

BACKGROUND OF THE INVENTION

Today's text-to-speech synthesis technology is capable of resembling human speech. These systems are being targeted for use in embedded devices such as Personal Digital Assistants (PDAs), cell phones, home appliances, and many other devices. A problem that many of these systems encounter is limited memory space. Most of today's embedded systems face stringent constraints in terms of limited memory and processing speed provided by the devices in which they are designed to operate. These constraints have typically limited the use of multilingual text-to-speech systems.

Each language supported by a text-to-speech system normally requires an engine to synthesize that language and a database containing the sounds for that particular language. These databases of sounds are typically the parts of text-to-speech systems that consume the most memory. Therefore, the number of languages that a text-to-speech system can support is closely related to the size and related memory requirements of these databases. Therefore, a need remains for a multilingual text-to-speech system and method that is capable of supporting multiple languages while minimizing the size and/or number of sound databases. The present invention fulfills this need.

SUMMARY OF THE INVENTION

In accordance with the present invention, a multilingual text-to-speech system includes a source datastore of source parameters providing information about a speaker of a primary language. A plurality of primary filter parameters provides information about sounds in the primary language. A plurality of secondary filter parameters provides information about sounds in a secondary language. One or more secondary filter parameters is normalized to the primary filter parameters and mapped to a primary source parameter.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

By way of introduction and with reference to FIG. 4, text-to-speech conversion in a source/filter model is carried as follows. First, input text is received at step 80. Then, the input text is normalized at step 82A. For example, numbers, dollar amounts, date and time, abbreviations, acronyms, and other text may all be converted to expanded text. Next, the normalized text is converted to phonemes at step 82B. This process may utilize rules and an exception dictionary. In addition, other processing may be performed at this step, such as morpheme analysis, part-of-speech determination, and other processing steps that help to determine/disambiguate pronunciation. In accordance with the present invention, steps 82A and 82B make up the front end processes that are replaced and/or supplemented when a language is added as discussed above. Prosody is generated next at step 84. Prosody generation includes segment durations, pitch contour, and loudness, such as rhythm, intonation, and intensity of speech. Finally, sound waveform is generated at step 86, resulting in output of speech at step 88. In accordance with the present invention, step 86 is performed using the source/filter approach explained below.

It should be readily understood that the speech generation architecture described above is simplified. In modern speech synthesizers the operation is not necessarily linear as shown. For example, some prosody generation and sound generation processing may overlap.

In accordance with the present invention, the front-end of the synthesizer refers to the text normalization and letter-to-sound modules. Although all of the modules are language dependent and even speaker dependent, the actual text normalization and letter-to-sound processes are most closely tied to the language of the input text.

Figure 5A:
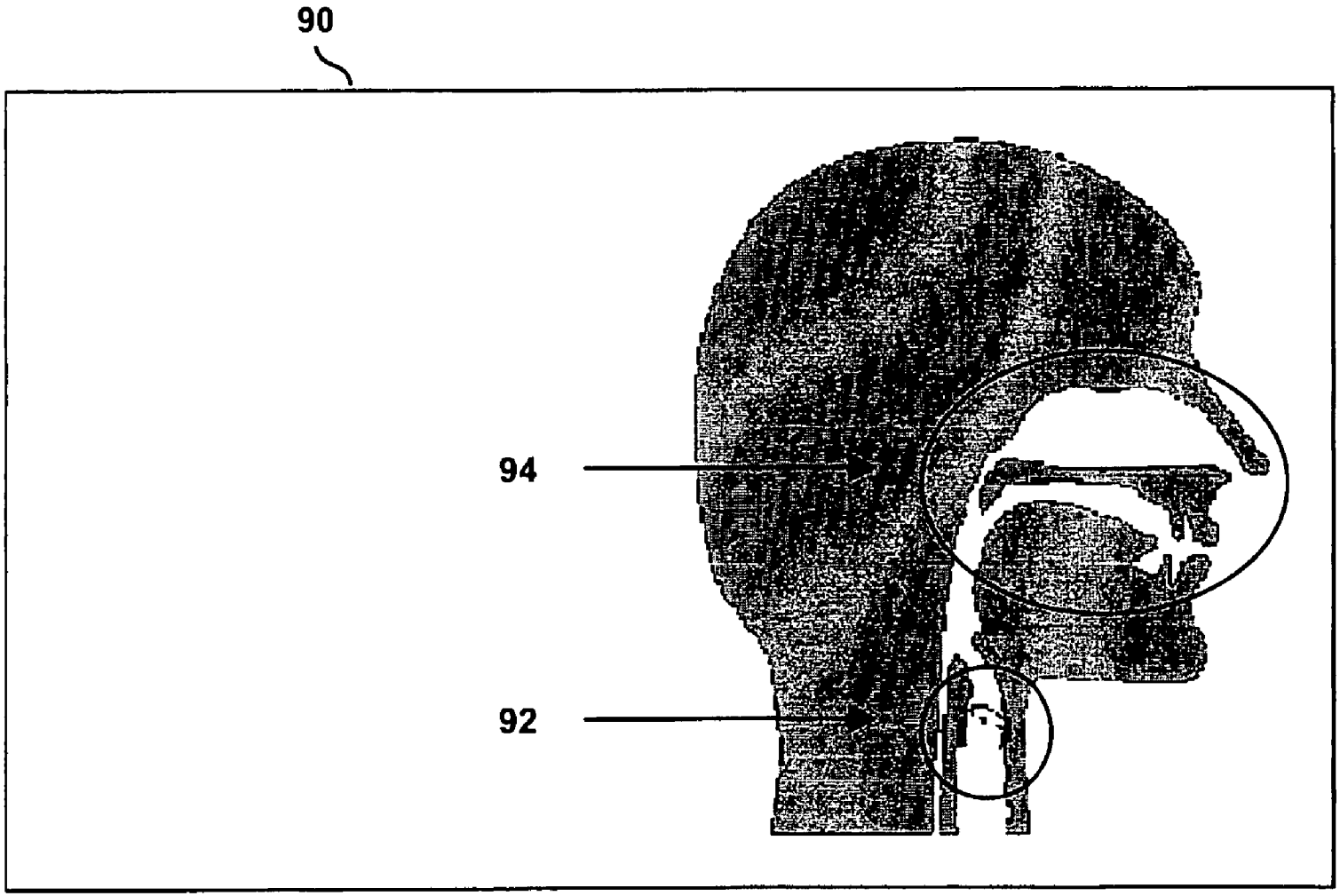
FIG. 5 is a block diagram illustrating the source filter model in accordance with the present invention.
Figure 5B:
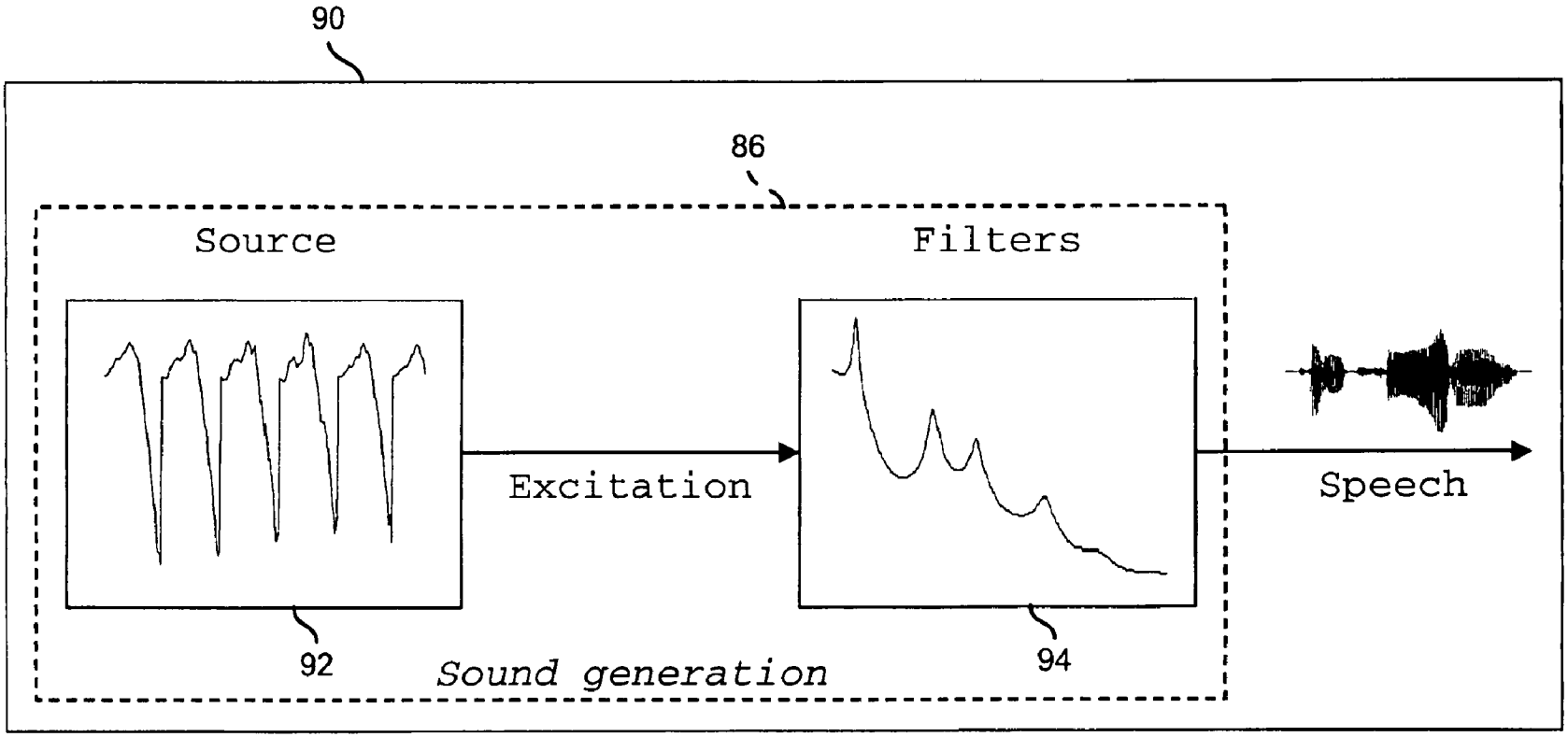

Referring to FIG. 5, human speech is generated by a flow of air passing through the vocal tract. In the case of voiced speech, the passing air causes the vocal cords to periodically vibrate. This periodic vibration occurs at a fundamental frequency rate also termed pitch. A resulting vibrating flow of air, called excitation, then passes through the vocal tract. The excitation can also be generated in other parts of the speech apparatus, for example, at the front teeth/tip of tongue/lips for unvoiced fricatives. Shape of the mouth and nasal cavities then determines the overall power spectrum of the speech signal. This speech production can be approximated by a source/filter model 90. The model 90 includes a source 92 generating an excitation signal which is passed through a set of shaping, typically resonating, filters 94, thus generating a speech signal waveform.

The source/filter model 90 offers the advantage of decoupling voice source characteristics from the vocal tract characteristics of speakers.

Although both the source 92 as well as the filters 94 are characteristic for individual speakers, it is possible to manipulate the perceived speaker characteristics/identify by manipulating mainly the filter parameters. The filter parameters reflect the shape and size of the vocal tract.

Furthermore a speaker can produce a variety of voiced sounds, such as vowels, by keeping a constant voice source but manipulating the shape of the mouth, lips, tongue, and other portions of the filter region.

This invention utilizes the above-described characteristics of the source/filter model. The basic idea is to have source and filter data from a single speaker but be able to generate speech sounds outside of the speaker's domain, for instance sounds from other languages. The approach is to use and reuse the original speaker's source data as much as possible since it generally dominates the memory requirements. The approach is also to produce new sounds by adding appropriate new filter configurations. The add-on filters can, for example, be obtained from other speakers speaking a different language. When this is done, a problem arises since the original and add-on speakers are likely to have different vocal tract size, shape, and other attributes as a result of having different bodies. To correct this mismatch, one can normalize/manipulate the add-on filters so that they match filters of the original speaker giving an impression of a single voice, in this example speaking a different language. In addition, there is a varying degree of similarity between languages which contributes further to the memory saved by not having to store those filters that are sufficiently similar.

It should be readily understood that although the invention suggests reusing the source from a single speaker to generate speech in a multitude of languages, it is possible that some secondary source data providing information about a speaker in the second language may also have to be added. Most likely, the secondary source data will be unvoiced and needed only very rarely. This secondary source data may in some embodiments be obtained from source parameters of another speaker of the secondary language. This speaker may be selected based on similarity to the user, such as same sex and/or vocal range. In other embodiments, the source parameters may be obtained by asking the speaker to imitate a sound in the secondary language and then extracting the source parameters from received speech. In some embodiments, a target sound in the secondary language may instead be assigned a null filter parameter if no available source parameters are suitable. This null parameter still allows speech generation with an occasional dropped or omitted sound, but the speech may still be recognizable. For example, a native French speaker speaking English with an accent may typically pronounce a "Th" sound as a "Z" sound while dropping an "H" sound altogether. Nevertheless listeners who understand English may typically understand the resulting speech. Thus, the present invention may additionally or alternatively map some secondary filters to null sound source if no suitable source is available.

Figure 4:
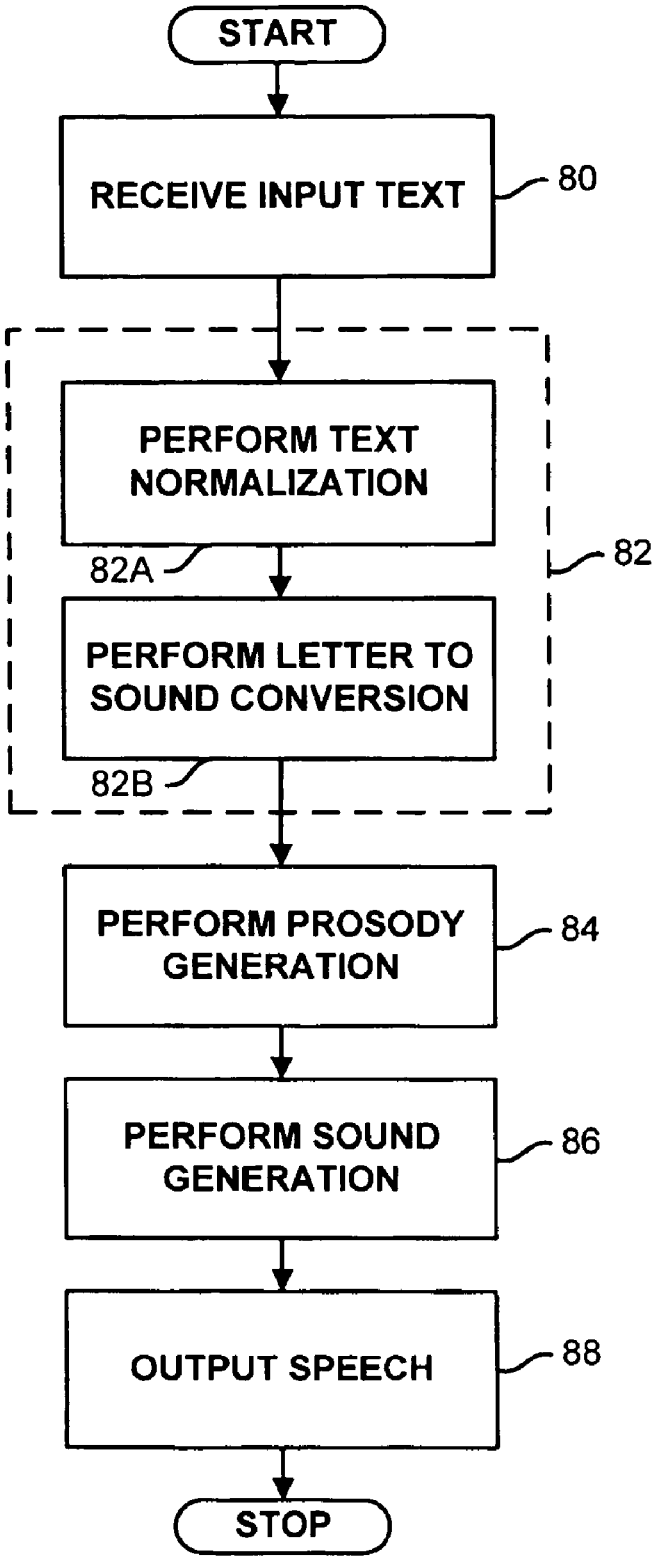
FIG. 4 is a flow diagram illustrating speech generation according to the present invention.

The shown source/filter parameterization which this invention is based on is only one of the possible sound generation approaches that may be employed in step 88 (FIG. 4).

The present invention employs one sound database and a few add-ons to generate multiple languages. The result is the capability of supporting multiple languages in an embedded system without resulting in a large increase in memory requirement. In effect, the present invention proposes a hybrid combination of synthesizer modules from different languages and sound databases from different speakers. Effectively, the present invention separates the front end text processing and letter-to-sound conversion from the rest of the text-to-speech system, and provides appropriate conversion modules. Furthermore, the sound database is reorganized to enable reuse of the sound units for multiple languages.

By way of overview, a number of examples illustrate variously combinable embodiments of the present invention. For example, an English core synthesizer can be combined with Spanish front-end processing and a Spanish add-on to the sound database. The result is speech synthesized from Spanish text but with an English accent supplied by the English voice. In another embodiment, it is envisioned that a synthesizer including a universal, language-independent, back-end sound generator may be combined with multiple, language-dependent, front-end modules. The result is a multilingual system with required memory resources significantly smaller than a set of the corresponding monolingual speech synthesizers. The invention thus provides an advantage by reducing storage resource requirements of a multilingual synthesizer engine. In addition, the ability of such a system to generate speech with various accents finds application in CGI characters, games, language learning, and other business domains.

Figure 1:
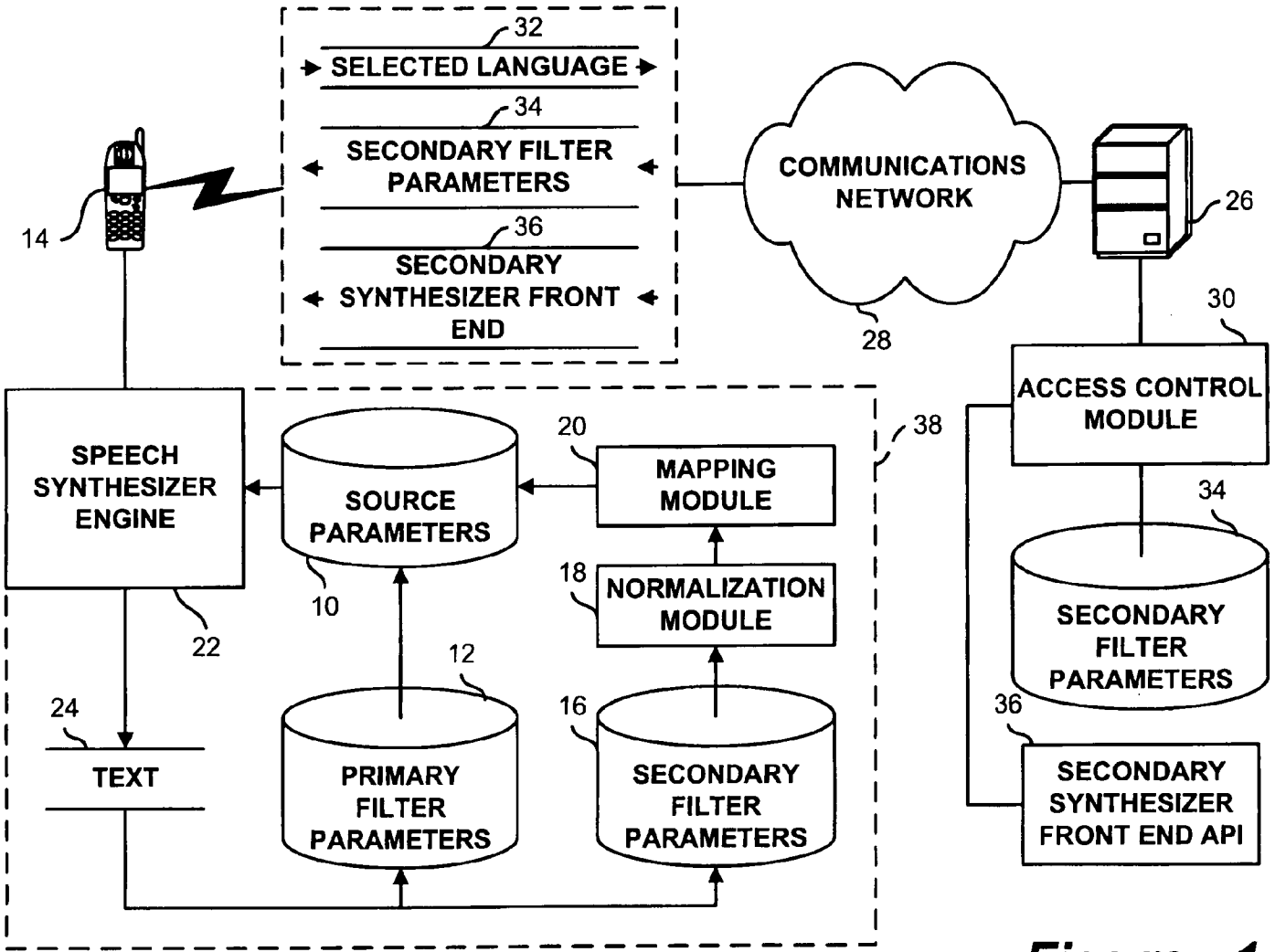
FIG. 1 is an entity relationship diagram illustrating a business model related to the multilingual text-to-speech system according to the present invention.

The invention obtains the aforementioned results in part by using a system for an initial or primary language as a base. The quality of speech generated using this base in a second language is increased by a number of conversions from the secondary language to the primary language, and a number of extra units from the second language to be used in the synthesis. Given a speech unit as the basis for speech synthesis, the unit is separated into source and filter parameters and stored in memory. In general, the filter parameters provide information about the sound, and the source parameters provided information about the speaker. This source-filter approach is well known in the art of text-to-speech synthesis, but the present invention treats the two parts differently as can be seen in FIG. 1.

In accordance with the present invention, the parameters representing all of the sounds in the primary language, including the source parameters 10 and the primary filter parameters 12, are stored in the memory resource of the embedded device 14. In order to synthesize speech in another language using the initial language, secondary filter parameters 16 relating to sounds not present in the primary language or very different from all sounds in the primary language are also stored in memory. The secondary filter parameters 16 are then normalized to the source and/or primary filter parameters of the primary language by normalization module 18.

The secondary filter parameters 16 are likely to come from a speaker other than the original speaker of the primary language. As a result, the secondary filters will probably not match the primary filters. If normalization is not performed, the generated speech may sound strange because the voice characteristics may change between the two speakers. Even worse, the mismatch can cause severe discontinuities of the generated speech. Hence, the secondary filters need to be normalized to match the primary filters. During the normalization, the source may optionally be considered. However, normalization of the secondary filters to the primary filters is of most importance. Therefore, the present invention preferably normalizes the secondary filters to the primary filters and not to the source. However, the source may optionally be considered during this process.

There are therefore two processes that need to be performed when borrowing filters from a secondary speaker/language. First, the secondary filters need to be normalized (i.e. modified/matched/etc) to the primary filters to ensure continuity and homogeneity of voice/parameters. Second, substitutes need to be found for the source parameters that are excluded from storage due to high memory requirements. This second technique is referred to as mapping of source parameters and optionally prosody parameters. Thus, the source parameters of the primary language are then reused for the secondary language by mapping the appropriate source parameters to the normalized, secondary filter parameters. This mapping function is accomplished by mapping module 20, and is based on linguistic similarities between a target sound in the secondary language and the source parameters 10 in the primary language.

It is envisioned that the present invention may include mapping of secondary filter parameters 16 to prosody parameters of a prosody generation model of speech synthesizer engine 22. There are numerous opportunities to introduce prosody mapping. For example, the source/filter parameters may evolve with respect to time. Normalizing the secondary filter parameters to match the primary ones accomplishes continuity of the filter parameters when switching between the primary and secondary ones. This normalization may cover nearly every aspect including timing changes. For example, the primary and secondary parameters come from different speakers and may thus reflect the way the speakers speak including the so-called duration model of the speaker. The duration model is a model that captures segmental durations, rhythm, and other time characteristics of one's speech. Therefore, in order to avoid mismatches in this domain, the normalization process may include mapping of the prosody model, the duration model in this case. However, since prosody in general refers also to the pitch and intensity, the mapping may occur with respect to these prosodic parameters as well.

There are several approaches to generating prosody: some are rule-based, others utilize large databases. Given the memory and computational limitation of embedded devices (cell phone, PDA . . . ), the following prosody generation approaches are of special interest: rule-based prosody generation, prosody generation utilizing a small database of prosodic parameters, and prosody generation optimized for a certain text domain. A possible implementation of the latter two cases is to utilize a database of prosodic contours (such as pitch and duration/rhythm contours) to generate prosody.

It is envisioned that the present invention may be employed with a system for generating prosody for limited text domains, such as banking, navigation/search, program guides, and other applications. The system thus envisioned stores prosody parameters for the fixed portions, such as "Your account balance is . . . "; and uses a database of prosodic templates to generate prosody parameters for the variable slots, such as " . . . five dollars.".) Given the fact that some of these implementations of prosody generation utilize a database of prosodic parameters, processing similar to the described secondary filter/source parameter processing may be performed, this time for the prosodic templates. For instance, new prosodic parameters (templates) may be mapped, added, merged, and/or swapped into an existing prosodic parameter database (similarly to the way secondary filter parameters can be added). Thus, secondary filter parameters may be imported with their own prosody parameters. Others may be mapped to prosody parameters intended for use with the source parameters. It may be a natural choice to import prosody parameters whenever secondary source parameters have to be imported. Alternatively, primary source parameters may be suitably useful, while suitable prosody parameters may not be present. Therefore, an assessment may be made to determine if primary prosody parameters are available that are suitably similar to secondary prosody parameters of secondary filter parameters and/or their associated secondary source parameters. An adjustable prosodic similarity threshold may be employed to accomplish proper memory management, with the similarity threshold being adjusted based on an amount of available memory.

Speech synthesizer engine 22 is adapted to convert text 24 from either the primary language or the secondary language to phonemes and allophones in the usual manner. The sound generation portion, however, uses both primary and secondary filter parameters with the source parameters to generate speech in the primary or secondary language. It is envisioned that a business model may be implemented wherein a user of the device 14 may connect to a proprietary server 26 via communications network 28. Access control module 30 is adapted to allow the user to specify a selected secondary language 32, and receive secondary filter parameters 34 and a secondary synthesizer front end 36 over the communications network 28. It is envisioned that secondary filter parameters 34 may be preselected based on a priori knowledge of the primary language. It is also envisioned that the secondary synthesizer front end 36 may take the form of an Application Program Interface (API) that provides additional and alternative methods that may overwrite some of the methods of the speech synthesizer front end. The resulting multilingual text-to-speech system 38 may be adapted, however, to receive an initial set of secondary filter parameters and dynamically adjust the size of the set based on available memory resources of the embedded device.

In accordance with FIG. 1, the business model thus implemented may be a fee-based service of providing language modules that users can download on-demand to their devices, such as a cell phone. One possibility here is for the service to send the secondary data (front-end, filter parameters, and possibly some source parameters, to the device and let the device compare the secondary parameters to the primary and existing secondary ones. Then, according to the available memory resources, decide which secondary parameters of the new language to keep.

It is alternatively envisioned that the device may communicate to the service what parameters (primary and possibly other secondary) are already present on the device, what new language is needed, what quality is desired, and how much memory is available. The service may then process secondary parameters of the desired new language to merge them with the parameters existing in the device. This way, this processing may be off-loaded from the device to the service and also the amount of data send over the communication network may be reduced. Assuming that the service has some knowledge about parameters of various languages, the device does not have to send actual parameters to the service, but only has to indicate what language(s) are present, with identifiers of the added secondary parameters. It is envisioned that the service may pre-normalize additional filter parameters to the primary filter parameters, pre-map the additional filter parameters to primary and/or additional source parameters, and pre-map the additional filter parameters to primary and/or additional prosody parameters. These additional linguistic parameters are pre-selected based on the amount of memory locally available on the device, and the pre-selection may be adjusted based on specified desired quality.

In addition to specified quality considerations, user's can strategically manipulate the amount of available memory. Thus, if a device already has secondary source, filter, and prosody parameters added to the primary language with appropriate mappings, then the service may add tertiary parameters for a third language with tertiary parameters mapped to primary and secondary source and prosody parameters. Likewise, if the user of the device has deleted a tertiary language in favor of supplementing a secondary language, the service may add more secondary parameters. Alternatively, a user may delete both the secondary and tertiary parameters and add back a more full set of secondary parameters. Additionally, a user may delete a secondary language and simultaneously add back the secondary language and a tertiary language so that the service can strategically select parameters for both languages based on the available memory for both languages.

Figure 2:
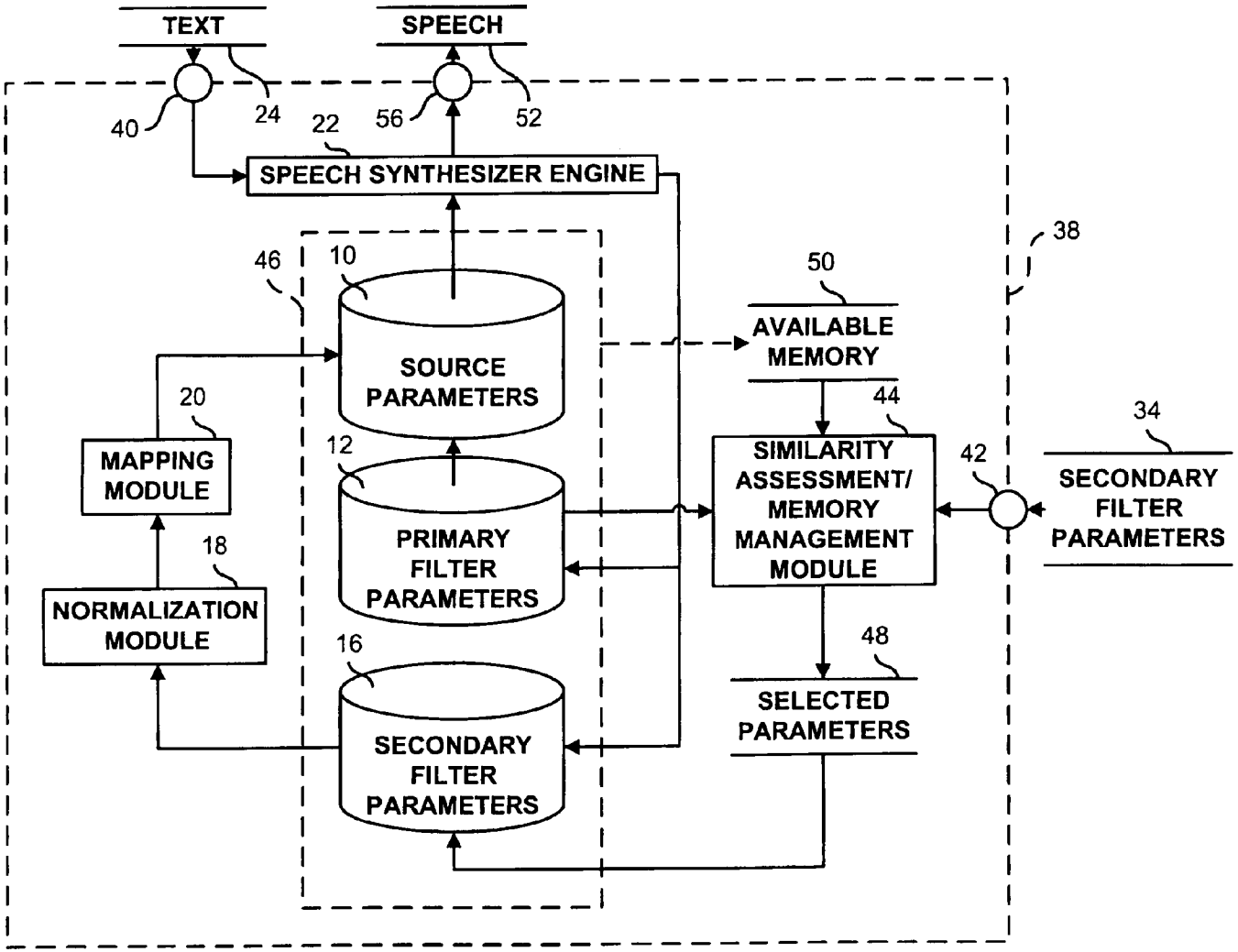
FIG. 2 is a block diagram illustrating the multilingual text-to-speech system according to the present invention.

FIG. 2 illustrates some aspects of the multilingual text-to-speech system in more detail. Accordingly, system 38 has inputs 40 and 42 respectively receptive of text 24 and an initial set of secondary filter parameters 34. System 38 also exhibits speech synthesizer engine 22, source parameters 10, primary filter parameters 12, secondary filter parameters 16, mapping module 20, and normalization module 18 as described above. However, system 38 additionally has a similarity assessment module and memory management module 44. Module 44 is adapted to assess similarity of the initial set of parameters 34 to the primary filter parameters. Module 42 is further adapted to compare similarity of the initial set of secondary filter parameters 34 to a similarity threshold, to select a portion 48 of the secondary filter parameters 34 based on the comparison, to store the portion 48 of the secondary filter parameters that are selected in a memory resource 46, and to discard an unselected portion of the initial set of secondary filter parameters 34. It is envisioned that the similarity threshold is selected to ensure that the secondary filter parameters 34 of the initial set that are related to sounds not present in the primary language are not discarded. It is also envisioned that module 44 may be adapted to monitor use of the memory resource 46 and to dynamically adjust the similarity threshold based on amount of available memory 50. Accordingly, system 38 is capable of generating speech 52 in multiple languages via an output 56 of the embedded device without consuming inordinate memory resources of the device in gaining the multilingual capability. The user of the device can therefore add languages as required.

Figure 3:
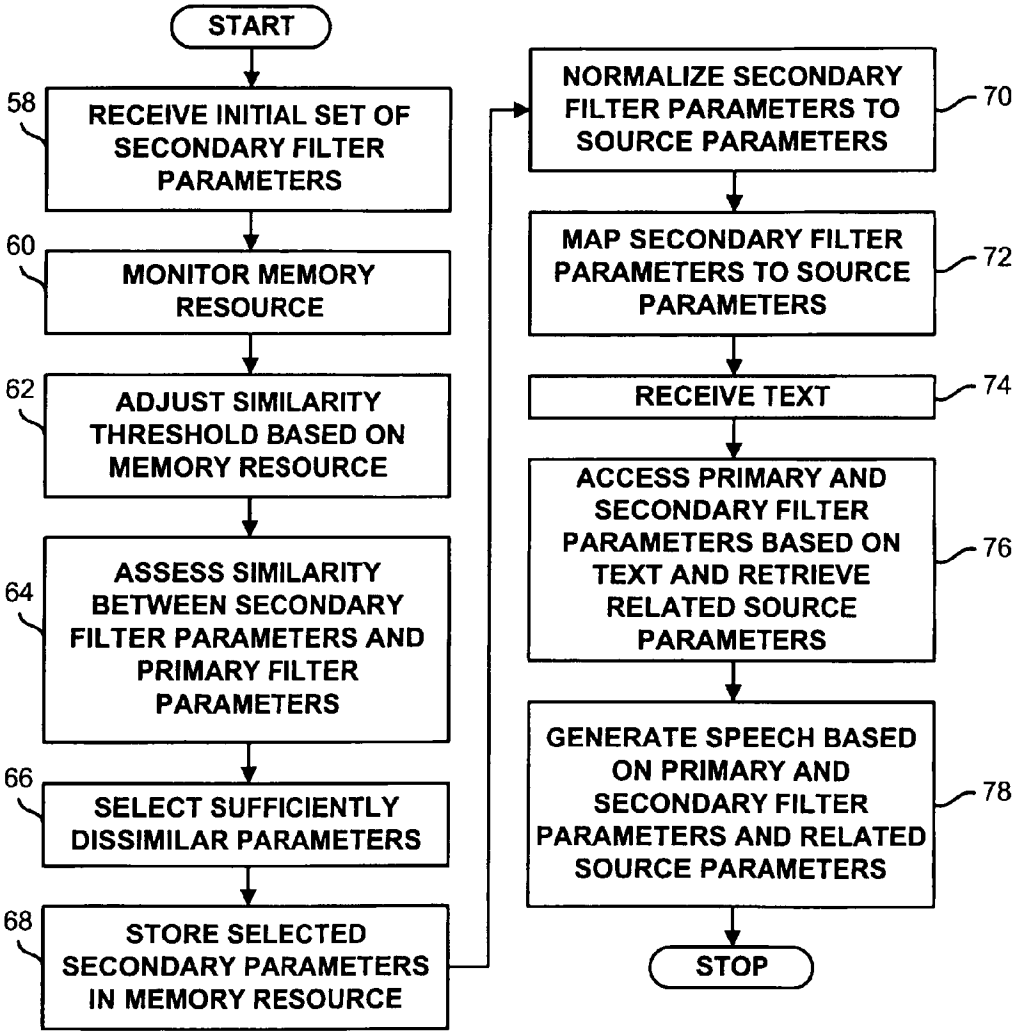
FIG. 3 is a flow diagram illustrating the multilingual text-to-speech method according to the present invention.

Referring to FIG. 3, the method of the present invention is illustrated. It includes receiving an initial set of secondary filter parameters at step 58, and monitoring the memory resource at step 60. A similarity threshold is then adjusted based on scarcity of the memory resource at step 62. Similarity between the secondary filter parameters and the primary filter parameters is then assessed at step 64, and sufficiently dissimilar parameters are selected at step 66 in accordance with the similarity threshold. The selected secondary parameters are stored in the memory resource at step 68, and the secondary filter parameters are normalized to the primary filter parameters at step 70. The normalized, secondary filter parameters are then mapped to the source parameters based on linguistic similarity between target sounds in the secondary language and existing source parameters in the primary language at step 72. Text is received at step 74 and appropriate front end speech synthesis leads to sound generation that includes access of primary and secondary filter parameters based on the text and retrieval of the related source parameters at step 76. As a further result, speech is generated based on the primary and secondary filter parameters and the related source parameters at step 78.

There are many uses for the present invention. For example, within all existing and future products that use speech synthesis, this invention provides a quick way to develop new languages for quick introduction of the product into new markets. It may also be used to test those markets without the cost and development time to create a language for that particular market. As there are languages where the differences between their sound structure is rather small, this invention allows generation of new languages with a limited loss in quality. It can also be used to synthesize texts written in multiple languages, all with the same voice. The voice is originally from one of the languages (the one which the user selects as his own nationality), and synthesizes the foreign language text. The loss of quality in the foreign languages is not very important, since all text may be read with a homogenous voice, which is the same as the speaker's nationality.

Also, having a voice that speaks many different languages or a language with different accents is useful for the video game industry, where the animated characters do not have to be perfect in sound quality. These characters may speak different accents, adding to the entertainment factor and the atmosphere of the game. Using the invention, this variety may be achieved easily with less expense than hiring people to record the prompts for the videogame. Furthermore, as the videogames are sold in a limited size medium, a large savings of memory results form using a synthesizer in various accents and only storing the text to be synthesized. The same principles also apply to animated CGI characters and computer animations.

Further, systems having important constraints regarding internal storage memory, can incorporate multiple language text-to-speech synthesis for the first time. In this case, a universal allophones to sound module is created with approximations to all possible sounds in all languages that need to be supported. The mapping from a particular language into the Universal set allows the generation of multiple languages with acceptable quality. Therefore, this invention provides an increase in value for products incorporating speech synthesis capabilities with a considerably small footprint in memory. This increase may have a great impact in mobile phones and PDAs, enabling the use of speech synthesis in multiple languages without memory constraints.

Yet further, actors involved in roles requiring imitation of a foreign language may train on a PDA at work or home, eliminating or reducing the need for a "dialect coach" providing this service. Besides being expensive, these are limited for consultation during recording hours and only employed by the main actors in the movies. The invention, however, provides similar benefits to actors of varying resources at any time.

Still further, the computer-assisted language learning industry may benefit from the invention. Many of the courses offer learning methods based on listening to real or synthesized speech in the target language to make the student confident in that language and make him learn the vocabulary and the pronunciation. The invention proposed here, together with the existing techniques in language learning, is capable of helping the student in detecting differences in pronunciation between the native language and the target language. It is also be useful for beginners to hear the target language with their own language intonation. This way, they are able to better understand the meaning of the words, as they are initially not trained to the new language sounds.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A multilingual text-to-speech system, comprising:

a source datastore of primary source parameters providing information mainly about a speaker of a primary language;

a plurality of primary filter parameters providing information mainly about sounds in the primary language; and a plurality of secondary filter parameters providing information mainly about sounds in a secondary language, wherein at least one secondary filter parameter of the plurality of secondary filter parameters is normalized to the plurality of primary filter parameters based on similarities between a) voice characteristics of the sounds whose information is provided by the plurality of primary filter parameters and b) voice characteristics of the sounds whose information is provided by the at least one secondary filter parameter, wherein the at least one secondary filter parameter is mapped to a primary source parameter.

2. The system of claim 1, further comprising a normalization module adapted to normalize the secondary filter parameters to the primary filter parameters.

3. The system of claim 1, further comprising a mapping module adapted to map the secondary filter parameters to the primary source parameters based on linguistic similarities between target sounds in the secondary language and primary source parameters in the primary language.

4. The system of claim 1, further comprising:

an input receptive of text; and a speech synthesizer adapted to convert the text-to-speech based on said primary filter parameters and said secondary filter parameters.

5. The system of claim 1, wherein said secondary filter parameters are selected based on at least one of their relationships to sounds not present in the primary language and their dissimilarities to said primary filter parameters.

6. The system of claim 1, further comprising:

a similarity assessment module adapted to assess linguistic similarity between target sounds in the secondary language and primary source parameters in the primary language;

a memory management module adapted to compare the linguistic similarities to a linguistic similarity threshold, store secondary source parameters providing information mainly about a speaker in the second language in memory based on linguistic similarity between the secondary source parameters and target sounds exhibiting linguistic similarities falling below the predetermined threshold; and a mapping module adapted to map secondary filter parameters providing information mainly about the target sounds exhibiting linguistic similarities falling below the predetermined threshold to the secondary source parameters based on linguistic similarity.

7. The system of claim 1, further comprising a plurality of primary prosody parameters, wherein at least one secondary filter parameter is mapped to a primary prosody parameter.

8. The system of claim 7, further comprising a plurality of secondary prosody parameters selected to supplement said primary prosody parameters, wherein at least one secondary filter parameter is mapped to a secondary prosody parameter.

9. The system of claim 1, further comprising:

a parameter output adapted to transmit an amount of available local memory and information relating to linguistic parameters stored in local memory to a supply of additional linguistic parameters not stored in local memory; and a parameter input receptive of additional linguistic parameters preselected based on the amount of available local memory, including additional filter parameters pre-mapped to said primary source parameters.

10. The system of claim 9, wherein the additional filter parameters are pre-normalized to said primary filter parameters.

11. The system of claim 9, wherein said parameter output is adapted to transmit a user-specified quality preference, and the additional linguistic parameters are preselected based on the user-specified quality preference.

12. The system of claim 9, wherein the additional filter parameters are pre-mapped to primary prosody parameters stored in local memory.

13. The system of claim 12, wherein the additional linguistic parameters include additional prosody parameters preselected to supplement the primary prosody parameters based on the amount of available local memory.

14. The system of claim 1, further comprising an input receptive of an initial set of secondary filter parameters.

15. The system of claim 14, further comprising a similarity assessment module adapted to assess similarity between the initial set of secondary filter parameters and said primary filter parameters.

16. The system of claim 15, further comprising a memory management module adapted to compare similarity of the initial set of secondary filter parameters to a similarity threshold, to select a portion of the secondary filter parameters based on the comparison, to store the portion of the secondary filter parameters that are selected in a memory resource, and to discard an unselected portion of the initial set of secondary filter parameters.

17. The system of claim 16, wherein the similarity threshold is selected to ensure that the secondary filter parameters of the initial set that are related to sounds not present in the primary language are not discarded.

18. The system of claim 16, wherein said memory management module is adapted to monitor use of the memory resource and to dynamically adjust the similarity threshold based on scarcity of the memory resource.

19. A method of operation for use with a multilingual text-to-speech system, comprising:

accessing primary source parameters providing information mainly about a speaker of a primary language;

accessing primary filter parameters providing information mainly about sounds in the primary language;

accessing secondary filter parameters providing information mainly about sounds in a secondary language, wherein at least one secondary filter parameter of the secondary filter parameters is normalized to the primary filter parameters based on similarities between a) voice characteristics of the sounds whose information is provided by the primary filter parameters and b) voice characteristics of the sounds whose information is provided by the at least one secondary filter parameter, wherein the at least one secondary filter parameter is mapped to a primary source parameter receiving text; and converting the text to speech based on the primary filter parameters and the secondary filter parameters.

20. The method of claim 19, further comprising normalizing the secondary filter parameters to the primary filter parameters.

21. The method of claim 19, further comprising mapping the primary source parameters to the secondary filter parameters based on linguistic similarities between target sounds in the secondary language and primary source parameters in the primary language.

22. The method of claim 19, further comprising receiving an initial set of secondary filter parameters.

23. The method of claim 19, further comprising selecting the secondary filter parameters based on at least one of their relationships to sounds not present in the primary language and their dissimilarities to the primary filter parameters.

24. The method of claim 19, further comprising:

assessing linguistic similarity between target sounds in the secondary language and primary source parameters in the primary language;

comparing the linguistic similarities to a linguistic similarity threshold;

storing secondary source parameters providing information mainly about a speaker in the second language in memory based on linguistic similarity between the secondary source parameters and target sounds exhibiting linguistic similarities falling below the predetermined threshold; and mapping secondary filter parameters providing information mainly about target sounds exhibiting linguistic similarities falling below the predetermined threshold to the secondary source parameters based on linguistic similarity.

25. The method of claim 19, further comprising:

accessing a plurality of primary prosody parameters; and mapping at least one secondary filter parameter to the primary prosody parameters.

26. The method of claim 25, further comprising:

accessing a plurality of secondary prosody parameters selected to supplement said primary prosody parameters; and mapping at least one secondary filter parameters to said secondary prosody parameters.

27. The method of claim 19, further comprising assessing similarity between the initial set of secondary filter parameters and the primary filter parameters.

28. The method of claim 27, further comprising:

comparing similarity of the initial set of secondary filter parameters to a similarity threshold;

selecting a portion of the secondary filter parameters based on the comparison;

storing the portion of the secondary filter parameters that are selected in a memory resource; and discarding an unselected portion of the initial set of secondary filter parameters.

29. The method of claim 28, further comprising selecting the similarity threshold to ensure that the secondary filter parameters of the initial set that are related to sounds not present in the primary language are not discarded.

30. The method of claim 28, further comprising:

monitoring use of the memory resource; and dynamically adjusting the similarity threshold based on scarcity of the memory resource.

31. The method of claim 19, further comprising:

transmitting an amount of available local memory and information relating to linguistic parameters stored in local memory to a supply of additional linguistic parameters not stored in local memory; and receiving additional linguistic parameters preselected based on the amount of available local memory, including additional filter parameters pre-mapped to said primary source parameters.

32. The method of claim 31, wherein the additional filter parameters are pre-normalized to said primary filter parameters.

33. The system of claim 31, further comprising transmitting a user-specified quality preference, wherein the additional linguistic parameters are further preselected based on the user-specified quality preference.

34. The method of claim 31, wherein the additional filter parameters are pre-mapped to primary prosody parameters stored in local memory.

35. The method of claim 34, wherein the additional linguistic parameters include additional prosody parameters pre-selected to supplement the primary prosody parameters based on the amount of available local memory.

36. A multilingual text-to-speech system, comprising:

a primary source module having a plurality of primary source parameters providing information mainly about a speaker of a primary language, wherein the plurality of source parameters defines a first sound source, of human speech, that generates a first excitation signal in the primary language;

a primary filter module having a plurality of primary filter parameters providing information mainly about sounds in the primary language, wherein the plurality of primary filter parameters define shaping applied to the first excitation signal to produce signal waveform of the sounds in the primary language; and a secondary filter module having a plurality of secondary filter parameters providing information mainly about sounds in a secondary language, wherein the plurality of secondary filter parameters define shaping applied to a second excitation signal, generated by a second sound source of human speech, to produce signal waveform of the sounds in the secondary language, wherein at least one of the plurality of secondary filter parameters is normalized to the primary filter parameters to imitate voice characteristics of the first sound source; and a mapping module that selects at least one from the plurality of primary source parameters to substitute at least one of a plurality of secondary source parameters based on linguistic similarities between a target sound defined by the substituted at least one secondary source parameter and a target sound defined by the selected at least one primary source parameter, wherein the plurality of secondary source parameters define the second sound source, wherein the system selectively applies at least one of the plurality of secondary filter parameters to the selected at least one primary source parameter.

* * * * *